137-13 SR
4/7/87 OR 4,655,237

United States Patent [19]
Gloor et al.

[11] Patent Number: 4,655,237
[45] Date of Patent: Apr. 7, 1987

[54] METHOD FOR REGULATING THE FLOW OF AN ELECTRICALLY CONDUCTIVE FLUID, ESPECIALLY OF A MOLTEN BATH OF METAL IN CONTINUOUS CASTING, AND AN APPARATUS FOR PERFORMING THE METHOD

[75] Inventors: Hans Gloor, Umiken; Eduard Müller, Winterthur, both of Switzerland

[73] Assignee: Concast Standard AG, Zürich, Switzerland

[21] Appl. No.: 706,782

[22] Filed: Feb. 28, 1985

[30] Foreign Application Priority Data

Mar. 7, 1984 [CH] Switzerland ..... 1132/84

[51] Int. Cl.[4] ..... F15C 1/04
[52] U.S. Cl. ..... 137/13; 137/807; 137/827; 137/828; 137/251.1; 137/334; 222/593; 164/489; 164/502; 266/237
[58] Field of Search ..... 137/807, 827, 828, 13, 137/334, 251; 222/593, 594; 266/237; 164/466, 489, 502

[56] References Cited

U.S. PATENT DOCUMENTS

| | | | |
|---|---|---|---|
| 2,970,830 | 2/1961 | Siegfried | 266/237 |
| 3,268,958 | 8/1966 | Sidabert | 164/466 |
| 3,701,357 | 10/1972 | Granström et al. | 137/827 |
| 3,776,439 | 12/1973 | Settle | 164/502 |
| 3,931,960 | 1/1976 | Bamji | 266/237 |
| 3,943,964 | 3/1976 | Asselmon et al. | 137/344 |
| 3,987,840 | 10/1976 | Birat | 164/466 |
| 4,456,054 | 6/1984 | Henders | 164/502 |

FOREIGN PATENT DOCUMENTS 2457656 12/1982 Fed. Rep. of Germany .

*Primary Examiner*—A. Michael Chambers
*Attorney, Agent, or Firm*—Werner W. Kleeman

[57] ABSTRACT

In a method for electromagnetically regulating flow and in an apparatus for performing the method, a molten metal flowing in a pouring tube is inhibited in a central region of the pouring tube by an insert member installed in a conduit of the pouring tube and is diverted radially outward. An electromagnetic coil is arranged concentrically about the pouring tube for exerting constrictive electromagnetic forces upon the molten metal and thus regulating the flow of molten metal in a wide range.

19 Claims, 4 Drawing Figures

METHOD FOR REGULATING THE FLOW OF AN ELECTRICALLY CONDUCTIVE FLUID, ESPECIALLY OF A MOLTEN BATH OF METAL IN CONTINUOUS CASTING, AND AN APPARATUS FOR PERFORMING THE METHOD

BACKGROUND OF THE INVENTION

The present invention broadly relates to continuous casting and, more specifically, pertains to a new and improved method and apparatus for regulating the flow of an electrically conductive liquid, especially a bath of molten metal in continuous casting.

Generally speaking, the apparatus of the present invention comprises a pouring tube having a conduit, the conduit having a central region, and an electromagnetic coil having an electromagnetically effective length arranged concentrically about the pouring tube.

In continuous casting, the flow of metal from one vessel to another, for instance from a ladle to a tundish or from a tundish to a continuous casting mold, is regulated by stoppers or sliders or gates. The various disadvantages of these regulating members as well as the various malfunctions possibly arising during casting operation are largely known. A few examples are the so-called leaky or running stopper, the solidification of flow sections, the often insufficient regulability, the wear of mechanically moved components, the necessity of a hydraulical actuating or displacement mechanism, et cetera.

It has therefore been attempted in continuous casting according to the prior art to restrict or constrict the cross-section of metal flowing through the pouring tube by means of electromagnetic forces generated by coils arranged concentrically about the pouring tube. However, in this type of electromagnetic influence on the casting or pouring stream, the effect exerted is insufficient. In particular, it is not possible to completely stop the metal flow, since the metal flow to be influenced, for physical reasons, can indeed be restricted to a certain extent but not fully constricted.

SUMMARY OF THE INVENTION

Therefore, with the foregoing in mind, it is a primary object of the present invention to provide a new and improved method and apparatus for regulating the flow of an electrically conductive liquid, especially a stream of molten metal in continuous casting, which do not exhibit the aforementioned drawbacks and shortcomings of the prior art constructions.

Another and more specific object of the present invention is to provide a new and improved method and apparatus of the previously mentioned type for regulating the flow of an electrically conductive liquid and which permit better regulability in comparison to previously known stopper mechanisms or sliders, increased operational safety, lower maintenance costs and less physical wear.

It is a further significant object of the present invention to provide operationally reliable initiation and termination of the metal flow.

Yet a further significant object of the present invention resides in providing a new and improved construction of an apparatus of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the method of the present invention is manifested by the features that it comprises the steps of inhibiting the flow of the electrically conductive liquid, especially molten metal in the center of a conduit of a pouring tube and within an electromagnetically effective length of an electromagnetic field generated by a coil arranged around the pouring tube and allowing restrictive or constrictive electromagnetic forces capable of regulating the flow of the electrically conductive molten metal to act upon such electrically conductive molten metal for regulating the flow thereof.

The apparatus of the present invention is manifested by the features that it comprises a fireproof, heat-resistant or refractory insert member mounted in the conduit within the electromagnetically effective length of the electromagnetic coil, the refractory insert member having an upper portion and an outer side and occupying the central region of the conduit of the pouring tube at least with its upper portion, and that the electrically conductive molten metal regulated by the electromagnetic forces flows on the outer side of the refractory insert member.

The flow of electrically conductive liquid, typically molten metal, can be regulated up to complete stoppage or constriction by inhibiting or retarding the liquid or metal flow in the center of the electromagnetic coil and of the pouring tube within the electromagnetically effective length of the electromagnetic coil and by exerting restrictive or constrictive electromagnetic forces upon the metal or liquid. The configuration and strength of the electromagnetic field then determines, under the given geometric conditions, the quantity of electrically conductive liquid or molten metal flowing through. A better regulation, or indeed the possibility of stopping the flow, is thus realized.

It is advantageous for the metal flow to be inhibited while diverting the flowing metal outwardly within the effective length of the electromagnetic coil, since in this case the forces generated by the electromagnetic coil act directly counter to the direction of flow of the electrically conductive metal. The effective length of the electromagnetic coil is to be understood as approximately the physical length of the electromagnetic coil in the coil axis.

For completely interrupting the flow of molten metal, it is advantageous to briefly interrupt the metal flow by means of the electromagnetic effect of the electromagnetic coil, to cool the metal situated in the pouring tube conduit to solidification and to subsequently switch off the electromagnetic field. In this manner a reliable closure or stoppage can be formed even for long durations. Remelting, if desired, is possible by external action, for instance by turning on the electromagnetic field.

A further advantageous possibility consists in cooling the metal situated before the effective length of the coil in the direction of flow and bringing it to solidification. A removal of the solidified metal plug can be effected by turning on the electromagnetic coil after lifting it to the height of the metal plug or by turning on a second electromagnetic coil permanently arranged at this height. In this manner, for instance in multiple strand plants, a selective resumption of casting after an interruption can be undertaken for individual strands.

It is equally advantageous to cool the metal in the pouring tube conduit and in the electromagnetically effective region of the electromagnetic coil and to bring it to solidification and to remelt it by inductive heating with the help of the electromagnetic coil at a desired time for selective initiation of metal flow, especially at initiation of casting in the continuous casting of steel strands. In this manner, for instance in multiple strand casting plants, a selective commencement of casting of individual strands can be undertaken.

The effect is attained by the refractory insert member filling out or occupying the center of the conduit of the pouring tube with at least its upper portion such that the metal flows on the outer side of the refractory insert member with the result that the electromagnetic influence by the electromagnetic coil acts in a zone close to the induction coil. The field strength requisite for regulation can be generated with low energy requirements in such a zone. A better possibility of regulation or the possibility of stopping the flow of metal is thus realized.

The insert member preferably forms, conjointly with the pouring tube, an annular space whose length in the electromagnetically effective region of the electromagnetic coil influences the regulation characteristics.

It is advantageous for the diameter of the refractory insert member filling out or occupying the center of the pouring tube to be selected in relation to the electrical conductivity of the stream of molten metal being poured or in relation to the frequency of the coil current or both. A particularly good possibility of regulation results when the diameter of the refractory insert member is greater than three times the penetration depth of the electromagnetic field into the bath of molten metal. This penetration depth is to be understood as the penetration dimension as described in the German Patent Publication No. 1,803,473, published May 21, 1970.

The conduit or flow channel of the pouring tube preferably has an enlarged stepped portion or enlargement stepped out in the direction of the flow of the metal to a space or chamber and the refractory insert member is secured to this enlargement in spaced relationship to the end face of such space or chamber. The flow of metal is thus displaced into an outwardly situated gap, that is an annular space. The metal can be well restricted or constricted in the space preceding the gap, so that no more metal flows through the annular space delimited by the outer surface of the refractory insert member and by the inner surface of the pouring tube when there is sufficiently large inward displacement of the molten metal.

The refractory insert member preferably has bores or flow channels in its upper portion through which the molten metal can flow out of the annular space or chamber into a central flow channel or conduit of the refractory insert member and can flow downwardly within this flow channel or conduit. The metal, for instance steel, can thus be centrally introduced into a subsequent vessel, which is particularly advantageous for small strand formats.

According to a further distinguishing characteristic of the invention, the refractory insert member can be adjustable in height within the pouring tube, for instance by means of a screw thread provided in the enlarged stepped portion or bore of the pouring tube. The spacing of the upper portion of the refractory insert piece or member to the end face of the enlarged stepped portion or bore can thus be varied, i.e. this flow space can be adapted to the momentary conditions by varying the space formed between the inner surface of the pouring tube and the top surface of the inserted refractory insert piece or member.

A thermally and electrically well-conducting annulus can furthermore be arranged in the pouring tube before the upper portion of the refractory insert member as seen in the direction of flow of steel and concentrically about the flow channel or conduit. This thermally and electrically conductive annulus or ring can be impinged with a cooling agent through a supply conduit. As will be described hereinbelow in an illustrative embodiment, a particularly advantageous possibility of stopping and blocking off the flow of metal is thus provided.

According to a further distinguishing feature, the electromagnetic coil can be adjustable in height in the axial direction along the pouring tube, advantageously up to the height of the built-in or integral annulus or ring. A steel plug intentionally created for the purpose of stopping the flow of metal can thus be remelted again at any time.

A cooling member or heat sink can be mounted on the upper portion of the refractory insert member. This cooling member or body has the task of causing the metal which first flows into the pouring tube at initiation of casting to solidify. This cooling member is installed in the bore of the pouring tube before assembly of the pouring tube and the refractory insert member, but can also be integrated into the refractory insert piece or member. The cooling member can, for instance, comprise a metal cooling block or member connected with the refractory insert piece or member by means of dovetail guides.

If, for instance, a regulation of the flow quantity or flow rate from zero percent to 100 percent is required, then, according to a further embodiment, the metal flow can be diverted or deflected before entering the annular space into an upward direction of flow, i.e. opposite to gravity. In one exemplary apparatus embodiment, at least one flow opening or passage can be arranged in the refractory insert member such that the molten metal flows through this flow opening or passage before entering the annular space and can be conducted into the annular space from below and that bores for outflow from the annular space are arranged above a limiting edge of the refractory insert member on the metal entry side of the annular space. In such an apparatus, metal spatters caused by induced turbulence in the annular space fall back into a lower diversion channel. They can therefore not exit from the pouring tube.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
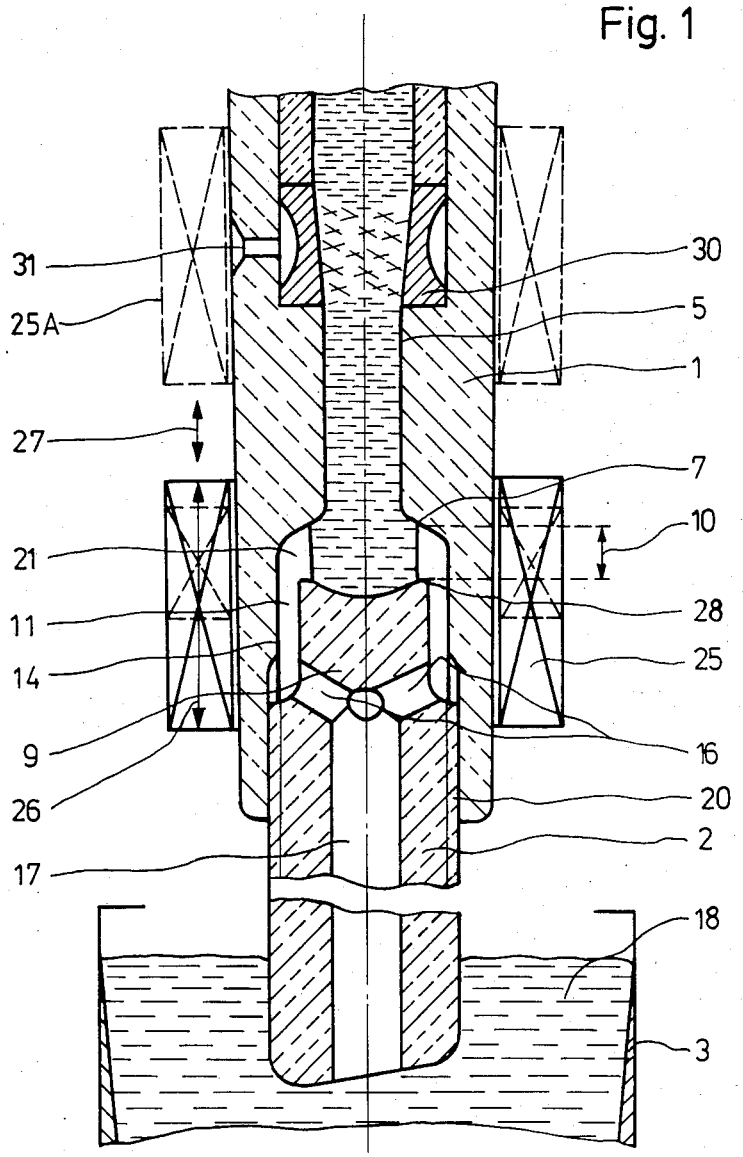
FIG. 1 schematically shows a first embodiment of the invention with a pouring tube, an insert member and an electromagnetic coil.

Describing now the drawings, it is to be understood that to simplify the showing thereof only enough of the structure of the apparatus for regulating the flow of an electrically conductive fluid has been illustrated therein as is needed to enable one skilled in the art to readily understand the underlying principles and concepts of this invention. Turning now specifically to FIG. 1 of the drawings, the apparatus illustrated therein by way of example and not limitation and employed to realize the method as hereinbefore described will be seen to comprise a refractory insert member 2 fastened in a pouring tube 1 which opens into a continuous casting mold 3 for producing a steel strand 18. The pouring tube 1 is situated beneath a not particularly shown pouring vessel, for instance a tundish, from which steel flows into a flow channel or conduit 5 of the pouring tube 1. The pouring tube 1 is provided with a stepped or incremented enlargement or enlarged portion of the conduit 5 which increases in size in the direction of flow of the steel to a space or chamber 21. An upper portion 9 of the refractory insert member 2 is situated at a spacing 10 from an end face 7 of the space 21. This upper portion 9 has a smaller diameter than the enlarged flow channel bore or conduit bore 14 of the pouring tube 1 and fills out or occupies the center of this bore 14 while forming an annular space or ring 11 between the inner wall of the pouring tube 1 and the upper portion 9 of the refractory insert member 2. A screw thread 20 permits variation of the spacing 10, so that a determinate flow cross-section immediately above the upper portion 9 can be adjusted for the space 21. An electromagnetic coil 25 is arranged concentrically about the pouring tube 1 such that the center of the electromagnetic coil 25 lies approximately in the height of the space 21.

The steel flowing from above through the pouring tube conduit 5 is conducted radially outward by the upper surface of the upper portion 9 and then flows downwardly along the annular space 11. The flow of metal is thus retarded or inhibited in an electromagnetically effective region or length of the electromagnetic coil 25, which approximately corresponds to a physical length 26 of the electromagnetic coil 25, and in the center of the coil 25 and of the pouring tube conduit 5. The upper portion 9 of the refractory insert member 2, for instance, has four bores 16 through which the steel is conducted to an axial and central flow channel or conduit 17, from which it can flow into a liquid core of the strand 18 being formed in the continuous casting mold 3.

When the electromagnetic coil 25 is supplied with an electric current, an electromagnetic influence is exerted on the steel exiting from the conduit 5 and flowing downwardly. A braking action is thus generated, since field forces act upon the outwardly flowing metal and give rise to an eddy current braking effect as the metal flows through the annular space or gap 11 and further lead to metal flow restriction or constriction and therefore to a reduced flow cross-section due to metal displacements generated by an increased field strength.

The coil length 26 can be dimensioned according to the desired effect. In a longer coil 25, which for instance extends over the length of the annular space 11, the share of the eddy current braking effect is greater and a finer regulation of the metal flow can be undertaken. In a shorter coil 25, whose effective region for instance principally comprises the space 21 lying immediately above the upper portion 9 of the refractory insert member 2 as shown in dotted line in FIG. 1, the effective action is more or less limited to a concentrated restriction or constriction of the steel in relation to an edge 28.

The electromagnetic coil 25 can be adjustable in height along the pouring tube 1 as indicated by the double-headed arrow 27. By selectively applying current to the electromagnetic coil 25, the flowing steel can be braked or stopped, by increasing the restriction or constriction, so far that a meniscus is displaced inwardly over the edge 28 of the upper portion 9, as indicated in FIG. 1. A simple and operationally reliable regulability of the metal flow from zero percent to 100 percent is thus possible without mechanically moved components and without mechanical wear. An undesired solidification of the steel in the apparatus can be excluded by inductive heating in the effective region of the electromagnetic coil 25 arranged around the pouring tube 1 at a small spacing.

In the embodiment represented in FIG. 1 for continuously casting a steel billet of 130 mm edge length, the diameter of the conduit 5 amounts to about 40 mm, the outer and inner diameters of the annular space 11 amount to about 65 mm and 60 mm respectively, the diameters of the four bores 16 amount to about 15 mm, and the axial bore 17 in the refractory insert member 2 has a diameter of about 25 mm. For these geometrical relationships and for a total ferrostatic height up to the center of the electromagnetic coil 25 of about 500 mm, it is to be expected that a regulation in the region of 50 percent to 100 percent flow rate will require about 7 kA. For a regulation in the range from 10 percent to 100 percent flow rate, coil current requirements of about 10 kA, and for complete termination of operation of about 15 kA, are to be expected. These requirements correspond to an employed voltage frequency of, for instance, 1000 Hz and a low voltage power supply.

A ring 30 of graphited fireproof or refractory material is installed in the pouring tube 1 concentric to the conduit 5 and is both thermally and electrically well-conductive. The ring 30 can be bathed or impinged with a cooling agent or medium, for instance air or inert gas, through a supply conduit 31. The possibility is thus realized, for instance at termination of casting, of stopping flow even without a continuously activated electromagnetic coil 25. For this purpose the flow is briefly electromagnetically interrupted or inhibited and the thermally well-conductive ring 30 is subsequently cooled until the metal in this region is completely solidified. Afterward, the coil 25 is turned off. The coil 25 can be shifted axially up to the height of the ring 30 due to its adjustability in height, so that the possibility also exists of inductively remelting a flow of metal interrupted in the above-described manner and resuming casting. A second electromagnetic coil 25A can also be provided in place of the adjustability in height of the electromagnetic coil 25. The second electromagnetic coil 25A is stationarily mounted in the height of the ring or ring member 30.

Figure 2:
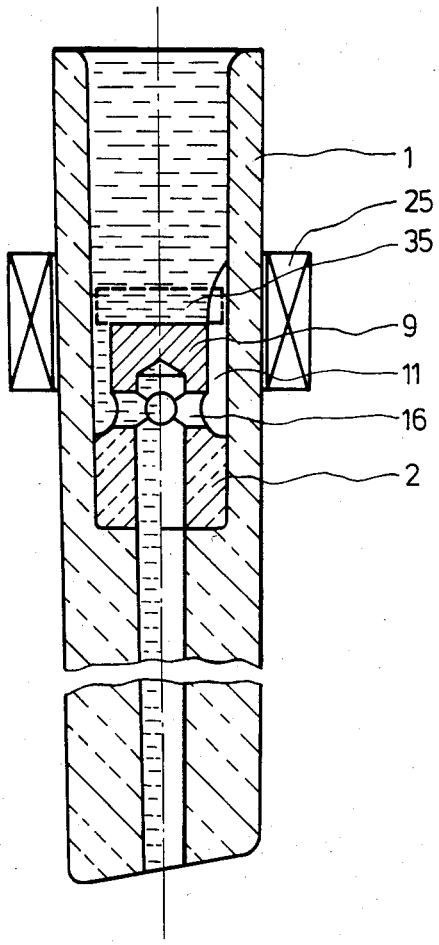
FIG. 2 schematically shows a further embodiment of the invention.

FIG. 2 shows a further embodiment in which the refractory insert member 2 is inserted into the pouring tube 1 from above. If required, this refractory insert member 2 can be mounted in the pouring tube 1 by means of a fireproof or refractory cement. In this embodiment the bores 16 lie at the same height. The action of the electromagnetic coil 25 is illustrated in the right half of the Figure. When the electromagnetic coil 25 is supplied with a sufficiently high current intensity, the material is radially constricted inwardly of the width of the upper portion 9 of the refractory insert member 2 and is in this manner inhibited or hindered from further flow through the space or chamber 11 formed between the inner wall of the pouring tube 1 and the upper portion 9. A cooling member or heat sink 35 in the form of a disk which is mounted upon the refractory insert member 2 before initiation of casting is indicated in dotted line. A regulated initiation of casting is thus possible in that, after pouring the steel into the pouring tube, flow of the metal is initially inhibited by a cooling effect of the cooling member or disk 35. The metal solidified in the region of the cooling member 35 can be temporally selectively melted by an inductive heating effect of the electromagnetic coil 25. The cooling member 35 can also be integrated into the refractory insert piece or member 2 and, for instance, can be fastened thereto or clipped thereover by means of a conventional dovetail-like guide.

The immersible pouring tube 1 illustrated in FIG. 2 immerses into the molten metal bath of a not particularly shown continuous casting mold. It will be clear that a shorter, non-immersive pouring tube 1 can also be employed.

A control or regulation of the electromagnetic forces influencing the quantity of metal flow can be effected through the current intensity flowing through the electromagnetic coil 25. It is also possible to vary the electromagnetic force on the melt with a prescribed fixed current intensity in that the electromagnetic coil 25 is shifted along its axis, or more generally, in that the geometric location of the electromagnetic coil 25 relative to the edge 28, respectively to the space 21, is varied or in that the current flow in the electromagnetic coil 25 is varied by electrical or mechanical current displacement. Furthermore, a combination of the above-described measures is conceivable.

In the exemplary embodiments of FIGS. 1 and 2, the electromagnetic coils 25 are arranged around the pouring tube 1. The spacing of the electromagnetic coil 25 from the annular space 11 is therefore influenced by the wall thickness of the pouring tube 1. The annular space 11 can, however, also be formed directly by the electromagnetic coil 25 and by a displacement body having the edge 28. In such an arrangement, the electromagnetic coil 25 can be coated with a thin layer of ceramic material and, for instance, may constitute an extension of the pouring tube 1. With such an arrangement the efficiency is considerable improved.

The displacement body can, in the sense of a further embodiment of the invention, be provided above the edge 28 with a stopper-shaped protuberance which forms a stopper closure conjointly with an appropriately formed pouring tube 1. If the displacement body is moved conjointly with an axially movable component of such pouring tube 1 in a direction toward the stationary portion of the pouring tube 1, then the plug-shaped protuberance can close or stop the stationary pouring tube. Such a stopper closure effective upwardly from below can, for instance, fully interrupt the outflow of metal as an emergency closure.

Figure 3:
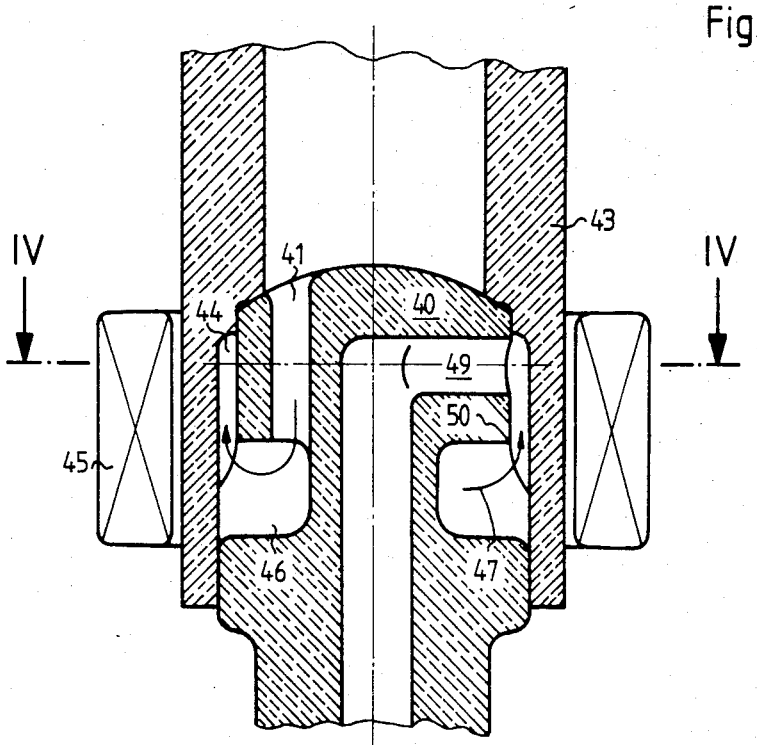
FIG. 3 schematically shows a section taken on the line III—III of FIG. 4.
Figure 4:
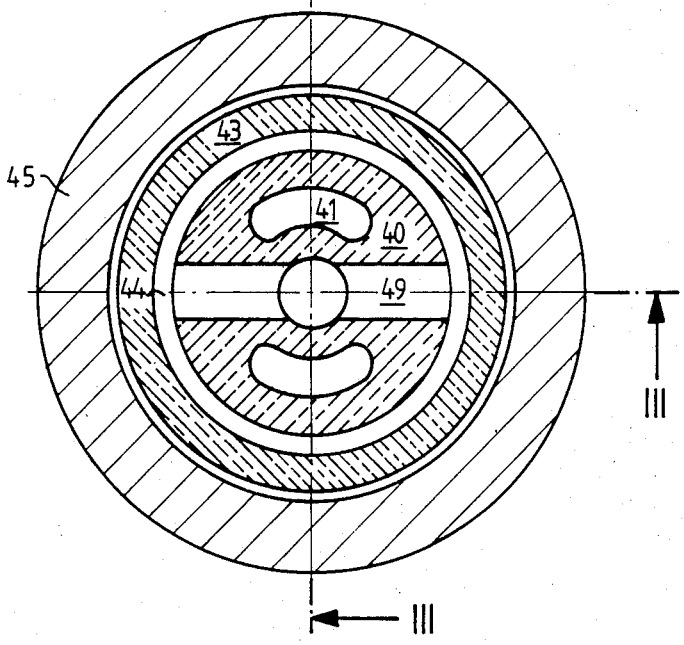
FIG. 4 schematically shows a section taken through a further embodiment of the invention on the line IV—IV of FIG. 3.

A fireproof or refractory insert member 40 having two flow openings or passages 41 is arranged within a pouring tube 43 in FIGS. 3 and 4. An annular space 44 is arranged within an effective region of an electromagnetic coil 45 between the refractory insert member 40 and the pouring tube 43. The flow openings or passages 41 open into an also annular diversion channel 46 in which the molten metal is diverted or deflected before entering the annular space 44 and being fed into the annular space 44 from below in the direction of the arrow 47. Bores 49 for the outflow of the molten metal from the annular space 44 are situated above a limiting edge 50 which defines the entry cross-section of the annular space 44.

The pouring tube 1 or 43, the refractory insert member 2 or 44 and the electromagnetic coil 25 or 45 are advantageously round, as shown in the Figures. It is however completely possible to also select other cross-sections such as oval, polygonal, et cetera.

The method and apparatus according to the invention can advantageously be employed in multiple strand casting plants. For instance, several billet or bloom strands 18 can be cast at small strand spacing with the same extraction speed and employing common plant components such as oscillators, roller guides, shears, et cetera. The electrical equipment for supplying the electromagnetic coils with current in multiple strand plants may include an independent intermediate frequency current supply for each individual strand or one intermediate frequency power supply per multiple strand plant with parallel or series connection of individual electromagnetic coils 25. The individual control or regulation of the individual strands 18 can be effected by one of the control possibilities mentioned above or by a combination thereof. When employing parallel connections, a control for the individual strands 18, for instance, by means of serial chokes with variable inductivities, is also conceivable.

The invention may be just as advantageously employed in so-called twin casting or twin molding in which two strands must be precisely synchronously cast.

While there are shown and described present preferred embodiments of the invention, it is to be distinctly understood that the invention is not limited thereto, but may be otherwise variously embodied and practiced within the scope of the following claims. Accordingly,

What we claim is:

1. A method for regulating the flow of an electrically conductive liquid, especially molten metal in continuous casting, comprising the steps of:

mechanically inhibiting by means of a refractory insert member installed within a pouring tube the flow of molten metal in the center of a conduit of said pouring tube, wherein at least an outer side of said refractory insert member forms with said pouring tube a substantially annular space, and within an electromagnetically effective length of an.electromagnetic field generated by an electromagnetic coil arranged around said pouring tube, said electromagnetically effective length of the electromagnetic field generated by the electromagnetic coil being arranged around the pouring tube at least above the entry side of said annular space; and allowing annularly constrictive electromagnetic forces capable of radially influencing the flow of molten metal and generated by said electromagnetic field to act upon the molten metal for regulating the flow thereof, said electromagnetic field constricting said electrically conductive liquid to flow subsatntially radially during a portion of its path above the entry side of said annular space and within said electromagnetically effective length.

2. The method as defined in claim 1, wherein:

said step of mechanically inhibiting the flow of molten metal entails mechanically diverting the flowing molten metal substantially radially outwardly within said electromagnetically effective length of said electromagnetic coil.

3. The method as defined in claim 1 for interrupting the flow of the molten metal, especially at termination of continuous casting of steel, comprising the further steps of:

briefly electromagnetically suppressing the flow of the molten metal;

cooling the molten metal situated in said conduit of said pouring tube;

causing said molten metal cooled in said conduit to solidify; and subsequently switching off said electromagnetic field.

4. The method as defined in claim 3, comprising the further steps of:

cooling molten metal situated before said electrically effective length of said electromagnetic coil within said conduit of said pouring tube as seen in the direction of metal flow; and causing said molten metal cooled in said conduit to solidify.

5. The method as defined in claim 1 for initiating the flow of the molten metal, especially at commencement of continuous casting of steel, comprising the further steps of:

cooling said molten metal in said conduit of said pouring tube within said electromagnetically effective length of said electromagnetic coil;

causing said molten metal cooled in said conduit to solidify; and inductively melting by means of said electromagnetic coil said molten metal solidified in said conduit at a predetermined desired time.

6. A method for regulating the flow of an electrically conductive liquid, especially molten metal in continous casting, comprising the steps of:

mechanically inhibiting by means of a refractory insert member installed within a pouring tube the flow of molten metal in the center of a conduit of said pouring tube and within an electromagnetically effective length of an electromagnetic field generated by an electromagnetic coil arranged around said pouring tube;

allowing annularly constrictive electromagnetic forces capable of radially influencing the flow of molten metal and generated by said electromagnetic field to act upon the molten metal for regulating the flow thereof;

deflecting the flow of molten metal before entry into an annular space arranged within said electromagnetically effective length of said electromagnetic field generated by said electromagnetic coil; and transporting the flow of molten metal in an upward flow direction.

7. An apparatus for regulating the flow of an electrically conductive liquid, comprising:

a pouring tube having a conduit;

said conduit having a central region;

an electromagnetic coil having an electromagnetically effective length arranged coneentrically about said pouring tube for generating an electromagnetic field such that said electromagnetic field interacts with said electrically conductive liquid for producing electromagnetic forces acting substantially radially within said pouring tube and within said electromagnetically effective length;

a refractory insert member mounted in said conduit within said electromagnetically effective length;

said refractory insert member having an upper portion and an outer side and partially obstructing said central region of said conduit of said pouring tube during flow of the electrically conductive liquid at least with said upper portion within said electromagnetically effective length such that said outer side of said upper portion defines a substantially annular space within said pouring tube; and said electrically conductive liquid regulated by said electromagnetic forces with said electrically conductive liquid flowing substantially radially into said annular space and then through said annular space and on said outer side of said refractory insert member.

8. The apparatus as defined in claim 7, wherein:

said annular space having a predetermined length; and said predetermined length being appropriately selected for influencing flow regulation of the molten metal within said electromagnetically effective length of said electromagnetic coil.

9. The apparatus as defined in claim 7, wherein:

said refractory insert member has a predetermined diameter at said upper portion thereof;

said electrically conductive liquid having electrical conductivity characteristics;

an electrical current being impressed on said electromagnetic coil at a predetermined frequency; and said predetermined diameter being selected in dependence of said electrical conductivity characteristics of said electrically conductive liquid and of said predetermined frequency of said electrical current.

10. The apparatus as defined in claim 7, wherein:

said refractory insert member has a predetermined diameter at said upper portion thereof;

said electrically conductive liquid having electrical conductivity characteristics; and said predetermined diameter being selected in dependence of said electrical conductivity characteristics of said electrically conductive liquid.

11. The apparatus as defined in claim 7, wherein:

said refractory insert member has a predetermined diameter at said upper portion thereof;

an electrical current being impressed on said electromagnetic coil at a predetermined frequency; and said predetermined diameter being selected in dependence of said predetermined frequency of said electrical current.

12. The apparatus as defined in claim 7, wherein:

said electromagnetic field penetrating said electrically conductive liquid to a predetermined penetration depth; and said predetermined diameter of said refractory insert member being more than three times as great as said predetermined penetration depth.

13. The apparatus as defined in claim 7, wherein:

said conduit of said pouring tube comprises a stepped enlargement forming a space;

said space defining an end face; and said refractory insert member being fastened in spaced relationship to said end face.

14. The apparatus as defined in claim 8, wherein:

said upper portion of said refractory insert member comprises bores;

said refractory insert member comprising an axial conduit; and said bores connecting said annular space with said axial conduit.

15. The apparatus as defined in claim 7, further including:

means for height-adjustably fastening said refractory insert member in said pouring tube.

16. The apparatus as defined in claim 7, wherein:

said pouring tube defines a pouring direction; and an electrically and thermally conductive annulus being arranged before said upper portion of said refractory insert member as seen in said pouring direction and concentrically about said conduit of said pouring tube.

17. The apparatus as defined in claim 16, further including:

means for adjusting said electromagnetic coil in height at least into the region of said thermally and electrically conductive annulus.

18. The apparatus as defined in claim 7, further including:

a cooling member mounted upon said upper portion of said refractory insert member.

19. The apparatus as defined in claim 7, further including;

bores for outflow of the electrically conductive liquid from said annular space;

said refractory insert member defining a limiting edge thereon;

said refractory insert member being provided with at least one flow passage;

said at least one flow passage being arranged for conducting the electrically conductive liquid through said at least one flow passage before the electrically conductive liquid enters into said annular space;

said annular space having a metal entry side;

said annular space being constructed to be fed with said electrically conductive liquid from below; and said bores being arranged above said limiting edge on said metal entry side of said annular space.

* * * * *